US007798863B2

(12) United States Patent
Zhuang et al.

(10) Patent No.: US 7,798,863 B2
(45) Date of Patent: Sep. 21, 2010

(54) MODULAR JACK HAVING A LEAD-IN CONFIGURATION FOR A COMPLEMENTARY MATING PLUG

(75) Inventors: Quan Zhuang, Kunshan (CN); Chun-Sheng Li, Kunshan (CN); Ji-Cheng Wang, Kunshan (CN); Li-Zhi Zhang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/384,149

(22) Filed: Apr. 1, 2009

(65) Prior Publication Data

US 2009/0280694 A1 Nov. 12, 2009

(30) Foreign Application Priority Data

May 6, 2008 (CN) ..... 2008 2 0116827

(51) Int. Cl.
*H01R 24/04* (2006.01)

(52) U.S. Cl. ..... 439/668

(58) Field of Classification Search ..... 439/668, 439/607.38, 607.4, 607.26, 607.54, 567, 439/676

See application file for complete search history.

(56) References Cited

U.S. PATENT DOCUMENTS

| | | | | |
|---|---|---|---|---|
| 6,350,156 | B1 * | 2/2002 | Hasircoglu et al. | 439/676 |
| 7,018,237 | B2 * | 3/2006 | Zhan et al. | 439/607.55 |
| 2002/0146114 | A1 * | 10/2002 | Kameya et al. | 379/433.05 |
| 2005/0026501 | A1 * | 2/2005 | Zhan et al. | 439/607 |
| 2008/0220657 | A1 * | 9/2008 | Rascon et al. | 439/676 |

FOREIGN PATENT DOCUMENTS

| | | |
|---|---|---|
| TW | 576571 | 2/2004 |

* cited by examiner

*Primary Examiner*—Jean F Duverne
(74) *Attorney, Agent, or Firm*—Andrew C. Cheng; Wei Te Chung; Ming Chieh Chang

(57) ABSTRACT

An electrical connector includes an insulating housing having a top wall (13), a bottom wall (19) and side walls (14) to define a receiving cavity (12) opening forward. The top wall (13) defines an opening (15) opened upward and forward. A pair of stopping portions (16) facing to each other being are formed on the top wall (13) and project into the opening (15), each of which includes a lead-in portion at a lower and rear corner thereof. A plurality of contacts (4) are assembled to the insulating housing, each of which includes a contacting portion (41) extending into the receiving cavity (12). A shell (2) is provided to shield the insulating housing (1). The lead-in portion of each stopping portion can provide facility operation during the mating process.

8 Claims, 6 Drawing Sheets

MODULAR JACK HAVING A LEAD-IN CONFIGURATION FOR A COMPLEMENTARY MATING PLUG

BACKGROUND OF THE INVENTION

1. Field of the Invention

The present invention relates to a modular jack adapted for receiving a complementary mating plug.

2. Description of the Related Art

TW Pat. No. 576571 discloses a modular jack receiving a mating plug therein. The modular jack includes an insulating housing defining a receiving cavity opened forwardly so as to run through a front face of the housing. The receiving cavity exposes to an exterior by penetrating an upper wall of the housing so as to form a wide opening surrounded by four frame members. The frame member adjacent to the front face splits downwardly so as to define a notch communicating with the receiving space and leaves a pair of stopping portions at opposite sides. The mating plug is inserted into the receiving cavity of the housing and includes a locking section located in the opening, wherein the locking section has a resilient arm projecting toward the notch and a pair of blocking portions engaged with the stopping portions to maintain the mating plug received in the receiving cavity.

When the mating plug is withdrawn from the receiving cavity, the resilient arm is pressed downward and temporarily received in the notch, meanwhile, the blocking portion moves downward with the resilient arm and releasing from the stopping portion. As the stopping portion has a pre-determined thickness to keep its intensity, the blocking portion needs to move a corresponding distance. However, the locking section is made from plastic material, the flexibility of the spring arm can not be maintained after multiple usages, and the blocking portions perhaps can not move the corresponding distance to releasing from the blocking portion. Hence, an electrical connector which can solve the problem is needed.

SUMMARY OF THE INVENTION

Accordingly, an object of the present invention is to provide an electrical connector facility for a complementary mating connector to be drawn out.

In order to achieve the object set forth, an electrical connector includes an insulating housing having a top wall, a bottom wall and side walls to define a receiving cavity opening forward. The top wall defines an opening opened upward and forward. A pair of stopping portions facing to each other are formed on the top wall and project into the opening. Each stopping portion defines a lead-in portion at a lower and rear corner thereof. A plurality of contacts are assembled to the insulating housing, each of the contacts comprises a contacting portion extending into the receiving cavity. A shell is provided to shield the insulating housing.

Other objects, advantages and novel features of the invention will become more apparent from the following detailed description of the present embodiment when taken in conjunction with the accompanying drawings.

DETAILED DESCRIPTION OF THE INVENTION

Figure 1:
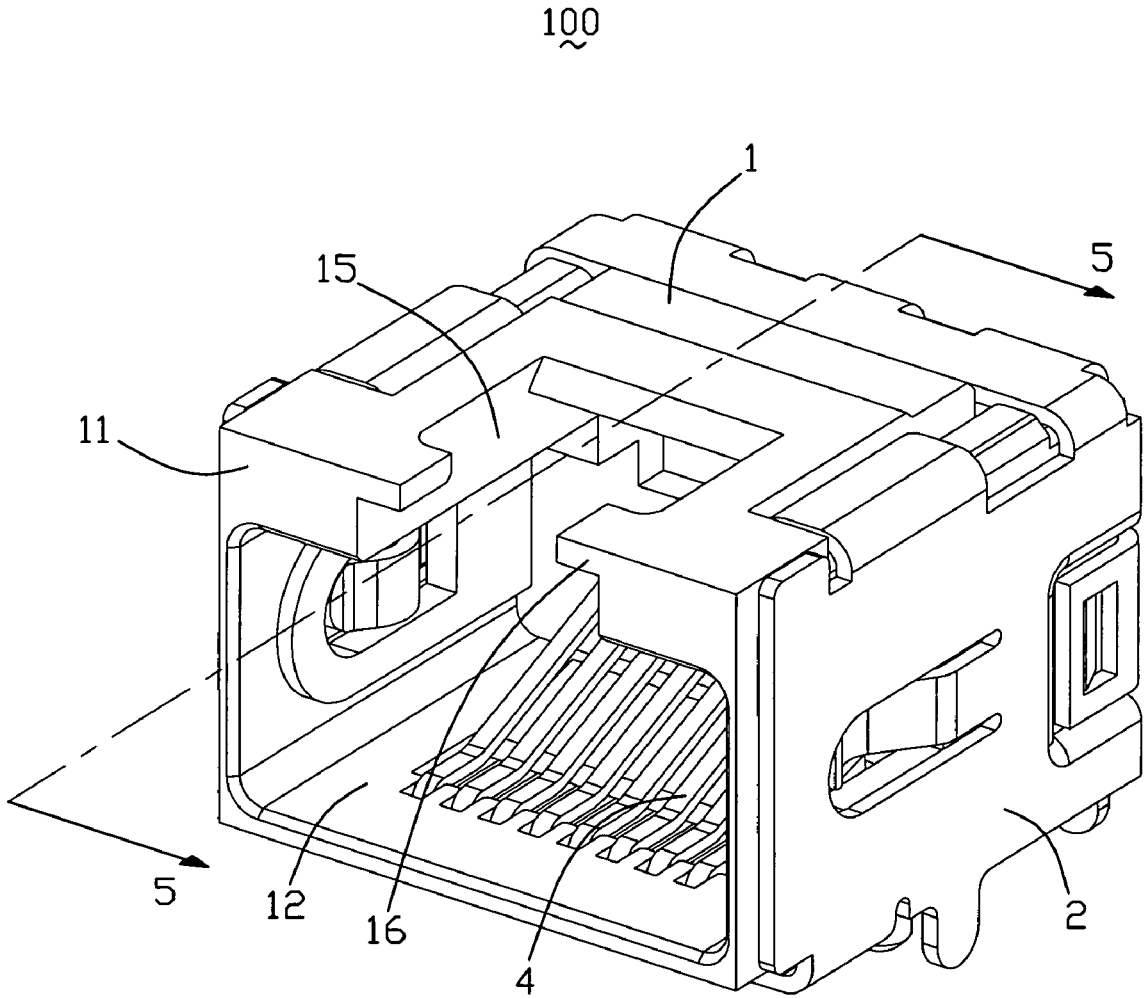
FIG. 1 is a perspective view of an electrical connector in accordance with the present invention.
Figure 2:
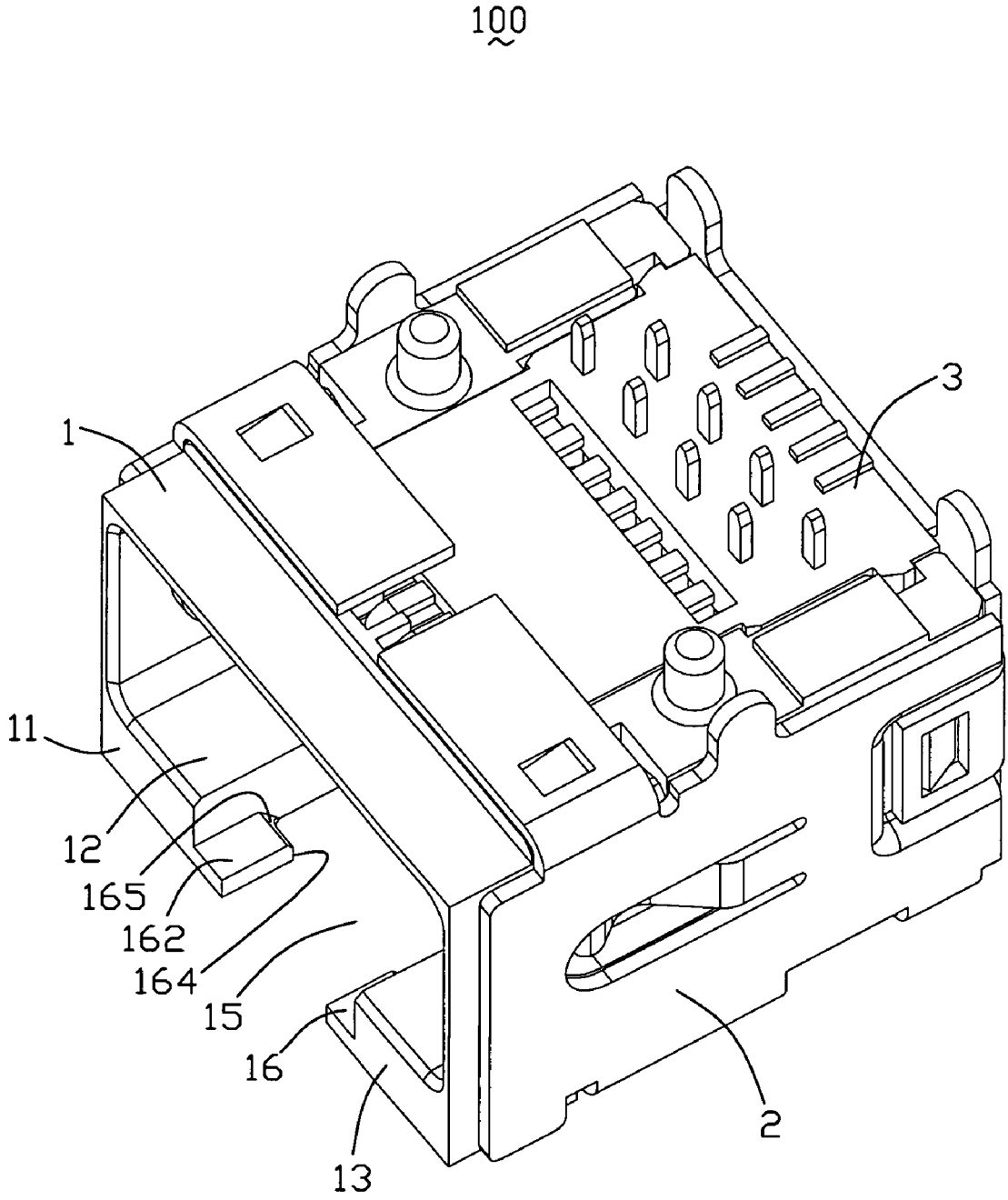
FIG. 2 is another perspective view of the electrical connector shown in FIG. 1.

Reference will now be made to the drawing figures to describe a preferred embodiment of the present invention in detail. Referring to FIG. 1, an electrical connector 100 according to the preferred embodiment of the present invention is provided and comprises an insulating housing 1, a plurality of contacts 4 assembled in the insulating housing 1 and a metallic shell 2 shielding the insulating housing 1.

Figure 3:
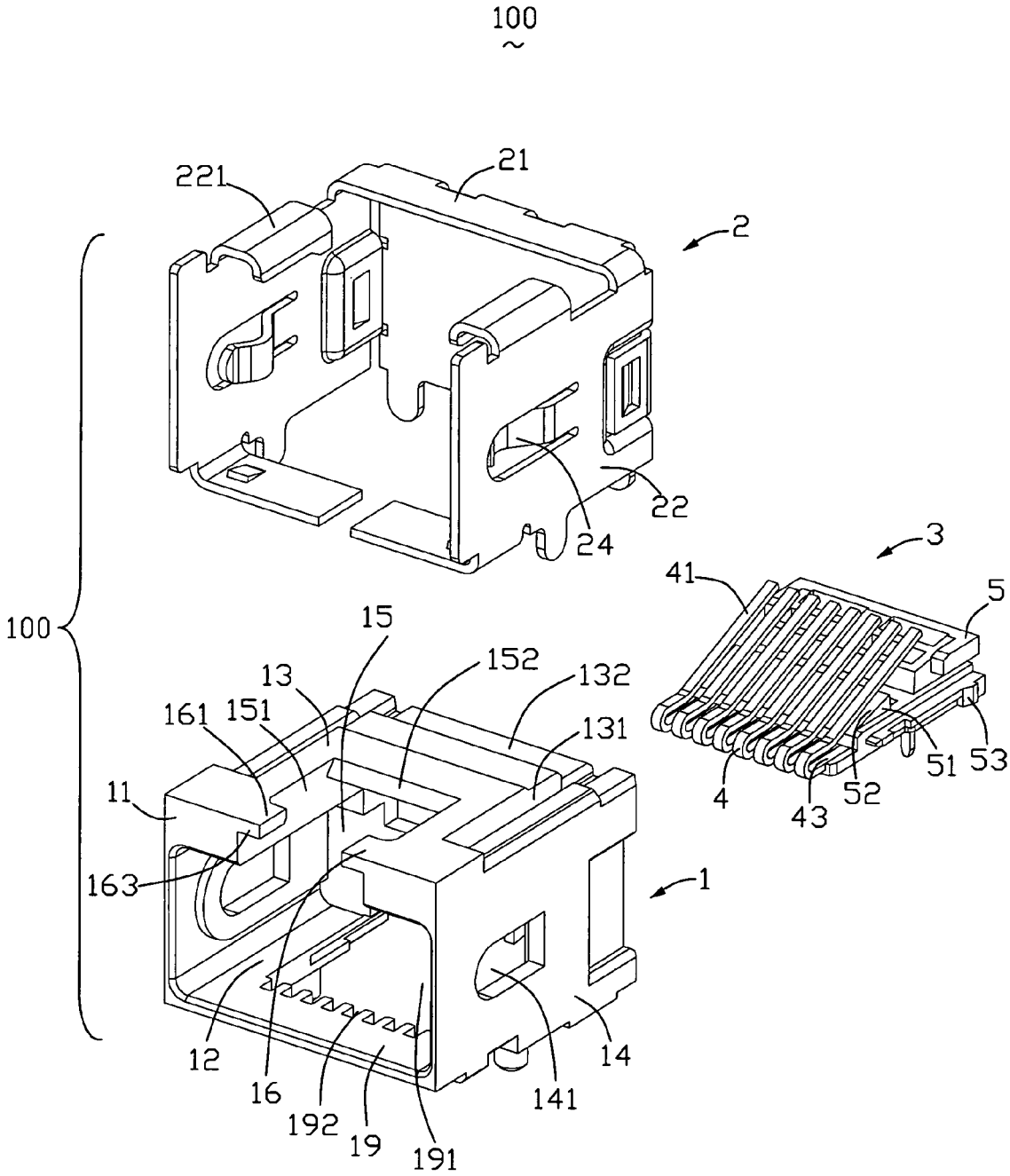
FIG. 3 is an exploded view of the electrical connector shown in FIG. 1.

Referring to FIG. 3, the insulating housing 1 has a rectangular hollow structure and defines a receiving cavity 12 recessed rearward from a front wall 11 of the insulating housing 1. The front wall 11 is also named as a mating face of the connector. The receiving cavity 12 is surrounded by an upper wall 13, a lower wall 19, a pair of side walls 14 connecting the upper and lower walls, and a rear wall opposite to the front wall. The receiving cavity 12 exposes to an exterior by penetrating the upper wall 13 so as to form a wide opening 15 opened forward and upward. A pair of opposing side faces 151 and a slanting face 152 connecting with the side faces 151, of the upper wall 13 are formed around the opening 15. The slanting face 152 slants forward and downward and faces to the mating face 11.

Figure 5:
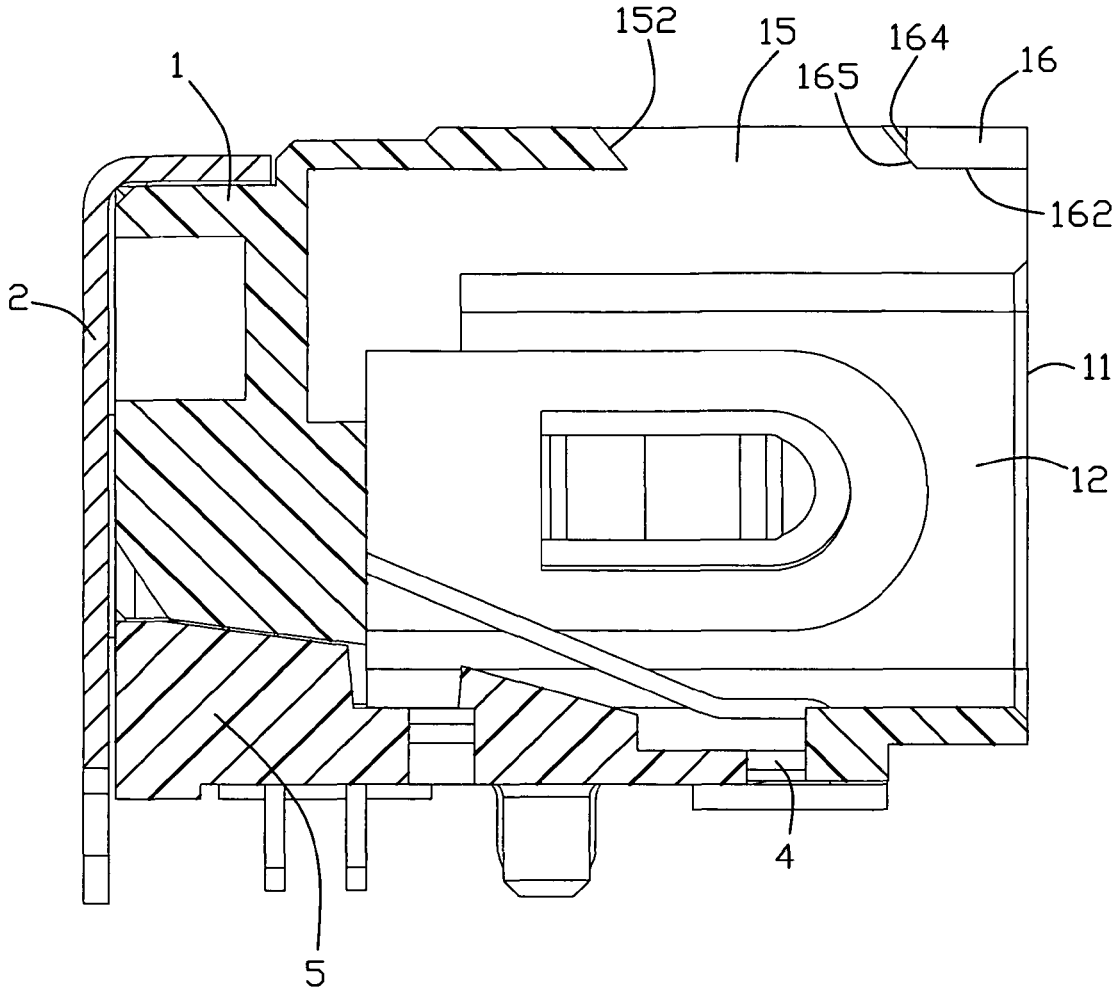
FIG. 5 is a cross-sectional view of the electrical connector shown in FIG. 1 along line 5-5.

Combination with FIG. 5, a pair of stopping portions 16 project toward each other at front-and-top corner of the side faces 151 respectively, which is thinner than the upper wall 13. Each stopping portion 16 defines a front face 163 coplanar with the front face 11, an upper face 161 coplanar with that of the upper wall 13, a lower face 162 opposite to the upper face, and a rear/stopping face 164 opposite to the front face 163. The stopping face 164 extends downward in a vertical direction and connects with the lower face 162 by a slanting guiding surface 165. The guiding surface 165 slants downward and forms a parallel relationship with the slanting face 152, therefore a die for molding the guiding surface 165 can be drawn out of the receiving cavity 12 along the slanting face 152 easily. As best shown in FIG. 5, the stopping portion 16 is a substantially rectangle shape along the cross-sectional view thereof, and the inner-and-lower corner are cut off to form the new side 165 (the guiding surface 165), thereby a thickness of the stopping face 164 is smaller than that of the front face 163.

The lower wall 19 defines an opening 18 therein, and a plurality of ribs 192 arranged at fixed intervals along a transverse direction extend toward the opening from a front portion of the lower wall 19, therefore a plurality of former grooves 195 are defined between neighboring ribs 192. At a rear portion of the lower wall 19, a plurality of clapboards 193 corresponding with the ribs 192 are formed along the transverse direction with rear grooves 195 which are defined between neighboring clapboards 193 in align with former grooves 195. The clapboard 193 spaces to the lower wall 19 and has an inclining surface so as to form a holding space for receiving the contact modular 3.

The plurality of contacts 4 are inserted molded in a contact modular 3 which has a retaining device 5 for securing the contacts therein. The retaining device 5 is in a wedge shape and defines an inclining surface. Each contact 4 has a body portion 43 molded in the retaining device 5, a resilient contacting arm 41 bending toward a rear end of the retaining device 5, and a soldering portion 42 extending downward from the rear end of the retaining device 5. The retaining device 5 has a stopping portion 51 located under the contacting arms 41, on which a slanting face 52 is formed and faces the contacting arms 41. The contact modular 3 is inserted into the opening 18 through the rear wall of the housing. The body portions 43 of the contacts 4 are received in the former grooves 195 and the resilient contact arms 41 are received in the rear grooves 195, meanwhile, the retaining device 5 is received in the holding space and engaged with the insulating housing 1 under a condition that two protrusions 53 formed at opposite sides of rear end of the retaining device 5 are retained in two apertures defined at opposite sides of rear end of the lower wall 19.

As the retaining device 5 defines a supporting portion 51 under the resilient contacting arms 41, when a complementary mating plug is inserted into the receiving cavity 12, the contacting arms 41 will receive in corresponding receiving channels defined in the mating plug and contact with mating contacts, however, if an unmatched mating plug is inserted into the receiving cavity 12, the contacting arms 41 could not receive in corresponding receiving channels defined in the mating plug, which will result in the contacting arms 41 being pressed downward and against the slanting face 52 of the supporting portion 51 so as to prevent the unmatched mating plug from further moving on. That is to say, the supporting portion 51 can realize an anti-mismating function.

Figure 4:
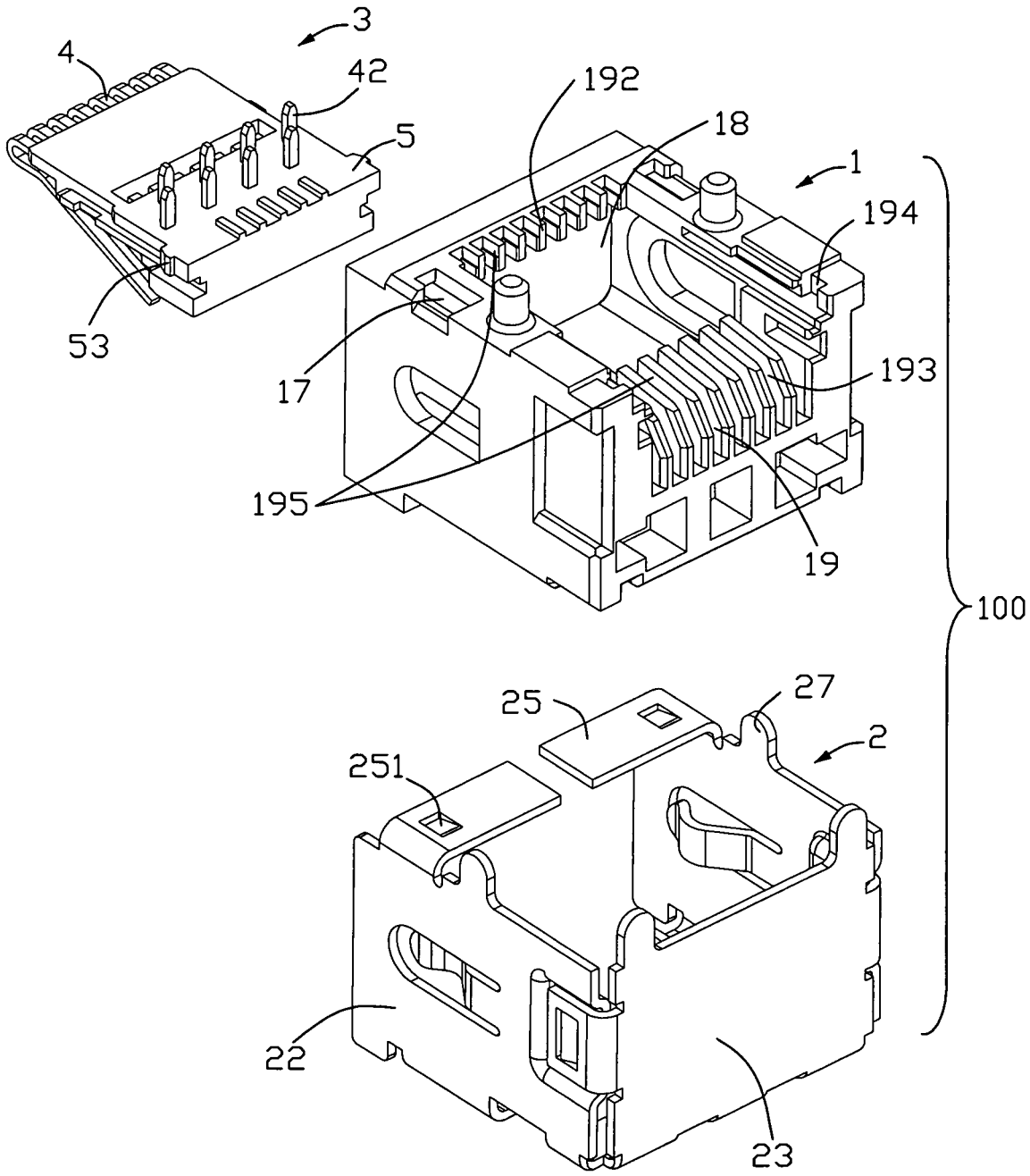
FIG. 4 is another exploded view of the electrical connector shown in FIG. 1.

As shown in FIGS. 3 and 4, the metallic shell 2 is made from a metal sheet and includes a pair of side walls 22, a top piece 21 connecting with some rear portions of the side walls, a rear piece 23 perpendicular extending from a rear end of the top piece. The top piece 21 covers on a rear-and-lower portion 132 of the top wall 13, which is lower to the stopping portion 16 of the top wall 13 of the housing. Each side piece 22 forms a locking plate 221 at an upper edge thereof to be received in a corresponding channel 131 in the upper wall 13 at side of the opening 15. Each side piece 22 forms a resilient plate 24 in a middle portion which project into the receiving cavity 12 through a gap 141 on the side wall 14 of the housing. The resilient plate 24 abuts against the insulating housing and prevents the shell 2 from rearward moving, moreover, the resilient plate 24 will contact with the mating plug and increase the mating force therebetween. A pair of holding plates 25 with tabs 251 thereon are formed on lower edges of the side pieces and locks with the lower wall 19 of the insulating housing. A plurality of solder legs 27 extend downward from rear pieces and side pieces for mounting the electrical connector onto a printed circuit board.

Figure 6:
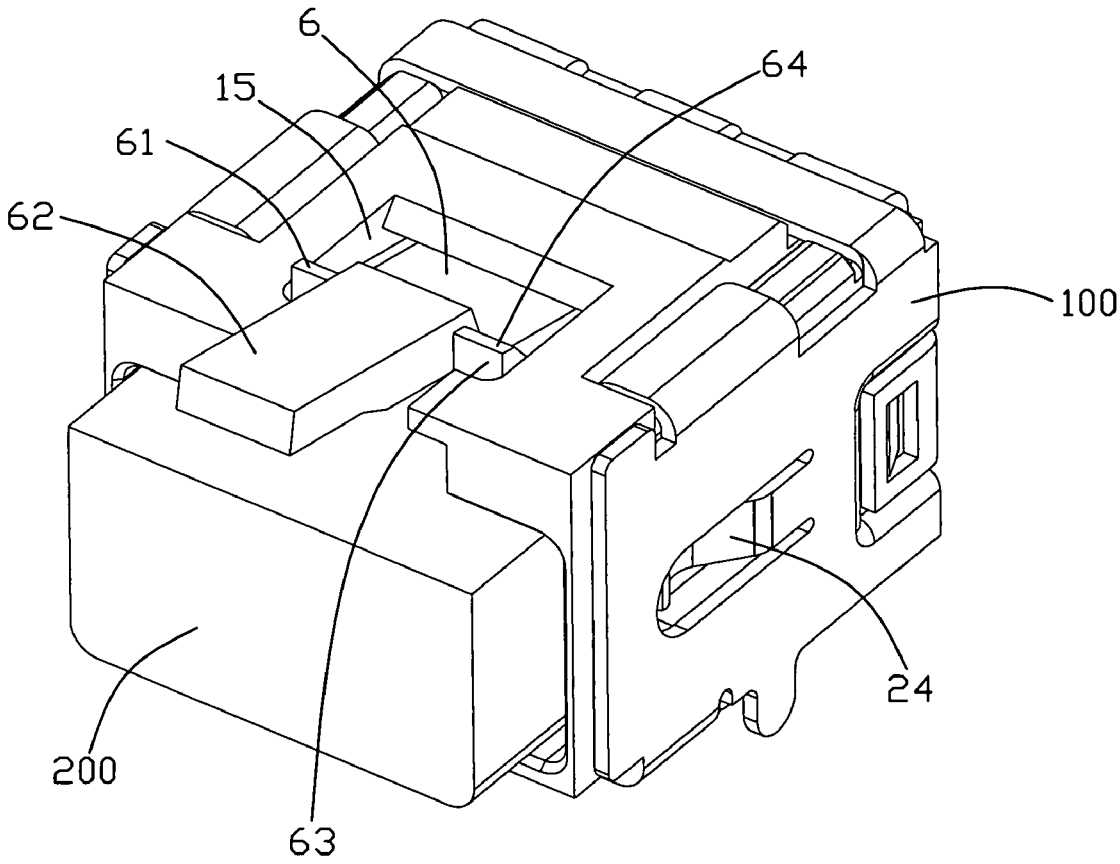
FIG. 6 is a perspective view of the electrical connector mating with a mating connector.

As shown in FIG. 6, a mating plug 200 is inserted into the receiving cavity 12 with a locking device 6 retained in the opening 15. The locking device 6 has an operating arm 62 projecting upward toward the mating face 11 and two blocking portions 61 located at opposite sides and blocked by the stopping portions 16. The blocking portions 61 has a vertical blocking face 63 abutting against the stopping face 164 and a horizontal top face 64 connecting with the stopping face 164. When the mating plug 200 is drawn out of the receiving cavity 12, the operating arm 62 together with the blocking portion 61 is pressed downwardly. The blocking face 63 of the blocking portion 61 moves downward along the stopping face 164, when the top face 63 of the blocking portion 61 reaches to a joint portion between the stopping face 164 and the guiding surface 165, the blocking portion 61 is no longer blocked by the stopping portion 16, and the mating plug can be drawn out of the receiving cavity 12 along the guiding surface 165 easily. As the exist of the guiding surface 165, the blocking portion 61 just need to move a distance equal to the length of the stopping face 164 in the vertical direction, not the thickness of the upper wall 13, and more, the guiding surface 165 provides a smooth surface for the mating plug to slid on, which is benefit for the mating plug to be drawn out.

In the present invention, the stopping face 164 together with the guiding surface 165 forms a lead-in configuration at rear end of the stopping portion 16 and provides facility operation during the mating process. And the resilient plate 24 of metallic shell exposes in the receiving cavity 12 for strengthening the mating force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing having a top wall, a bottom wall and side walls to define a receiving cavity opening forward, the top wall defining an opening opened upward and forward;

a pair of stopping portions facing to each other and being formed on the top wall and projecting into the opening, the stopping portion defining a lead-in portion at a lower and rear corner thereof;

a plurality of contacts assembled to the insulating housing, each of the contacts comprising a contacting portion extending into the receiving cavity; and a shell shielding the insulating housing; wherein each stopping portion comprises an upper face and a lower face, and said lead-in portion is located between the upper face and the lower face and comprises a vertical stopping face and a chamfered guiding surface connecting the stopping face and lower face; wherein the guiding surface slants downward and forward and faces to the receiving cavity so as to facilitate in releasing the mating plug from the stopping face when the mating plug is drawn out; wherein a slanting surface is formed at an edge of the opening opposite to the stopping face and parallel to the guiding surface.

2. The electrical connector as described in claim 1, wherein the lead-in portion comprises a stopping face to prevent the mating plug from releasing from the stopping portion, the length of the stopping face in a vertical direction is shorter than that of the stopping portion in the same direction.

3. The electrical connector as described in claim 2, wherein the bottom wall defines a window therein, a plurality of former grooves and rear grooves are respectively defined at opposite edges of the window for receiving said contacts.

4. The electrical connector as described in claim 3, wherein the rear grooves are spaced to the bottom wall so as to form a holding space for retaining a retaining device of the terminal insert.

5. The electrical connector as described in claim 1, wherein a supporting portion is located under the contacting portions and defines a slanting surface facing the contacting portions.

6. The electrical connector as described in claim 1, wherein the shell defines at least one resilient plate projecting into the receiving cavity through a gap defined on the side wall of the housing.

7. An electrical connector comprising:

an insulating housing having opposite top and bottom walls and opposite side walls to commonly define therein a receiving cavity forwardly communicating with an exterior via a first opening in a front face thereof, one of said the top wall and said bottom wall defining a second opening to vertically communicate said receiving cavity with said exterior;

a pair of stopping portions, for latching an inserted plug, facing to each other and being formed on said one of the top wall and the bottom wall adjacent to the front face and projecting into the second opening, each of the stopping portions defining at a rear corner thereof a chamfered structure obliquely and inwardly facing the receiving cavity; and a plurality of contacts assembled to the insulating housing, each of the contacts comprising a contacting portion extending into the receiving cavity; wherein each of said two opposite side walls defines a third opening to laterally communicate said receiving cavity with the exterior; further including a metallic shell attached onto the housing, wherein said shell defines a pair of resilient plates each extending through the corresponding third opening to enter the receiving cavity.

8. The electrical connector as claimed in claim 7, further including a metallic shell attached onto the housing.

* * * * *